US006488075B1

(12) United States Patent
Breviere et al.

(10) Patent No.: US 6,488,075 B1
(45) Date of Patent: Dec. 3, 2002

(54) SIDE WALL FOR INSTALLATION FOR CONTINUOUS CASTING OF METAL STRIPS

(75) Inventors: Yann Breviere, Ecquedecques (FR); Jean-Michel Damasse, Dusseldorf-Allemagne (DE); Dominique Themines, Krefeld (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/868,038

(22) PCT Filed: Dec. 17, 1999

(86) PCT No.: PCT/FR99/03175

§ 371 (c)(1),
(2), (4) Date: Jun. 29, 2001

(87) PCT Pub. No.: WO00/37198

PCT Pub. Date: Jun. 29, 2000

(30) Foreign Application Priority Data

Dec. 21, 1998 (FR) ..... 98 16185

(51) Int. Cl.[7] ..... B22D 11/06
(52) U.S. Cl. ..... 164/428; 164/480
(58) Field of Search ..... 164/479, 480, 164/481, 482, 428, 429, 430, 431, 432

(56) References Cited

U.S. PATENT DOCUMENTS 5,584,335 A * 12/1996 Barbe et al. ..... 164/428

FOREIGN PATENT DOCUMENTS

| | | |
|---|---|---|
| DE | 197 24 928 | 12/1997 |
| EP | 0 759 335 | 2/1997 |
| WO | WO 96/00626 | 1/1996 |

* cited by examiner

*Primary Examiner*—Kuang Y. Lin
(74) *Attorney, Agent, or Firm*—Oblon, Spivak, McClelland, Maier & Neustadt, P.C.

(57) ABSTRACT

A side wall closing the casting space of an installation for continuous casting of thin metal strips between unwinding cooled walls, including a support plate, on the rear face of which thrust members exert their action, and an active face arranged against the front face of the support plate. Lateral portions are designed to be worn by contact with the edges of the cooled walls over a maximum depth "e" and a length "1". The support plate and the active part are urged in contact with each other in a way enabling them to be disengaged non-destructively. The support plate front face has in its central part a recess whereof the depth is greater than "e" and the outer edges of the front face have a general shape which matches that of the outer edges of the active part and have a length less than "1".

8 Claims, 2 Drawing Sheets

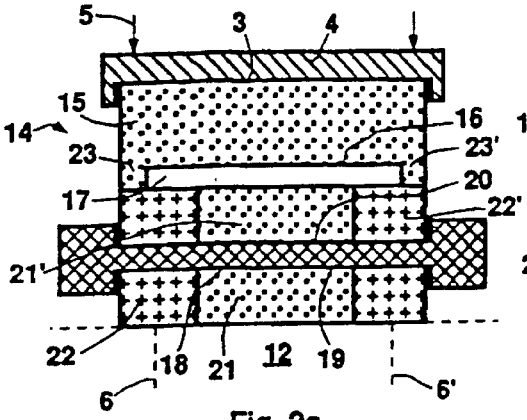
Fig. 2a
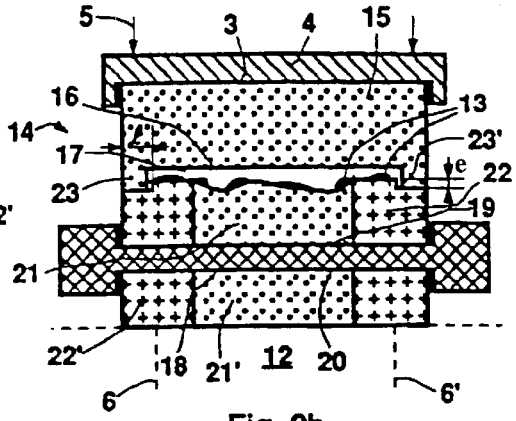
Fig. 2b
Fig. 2
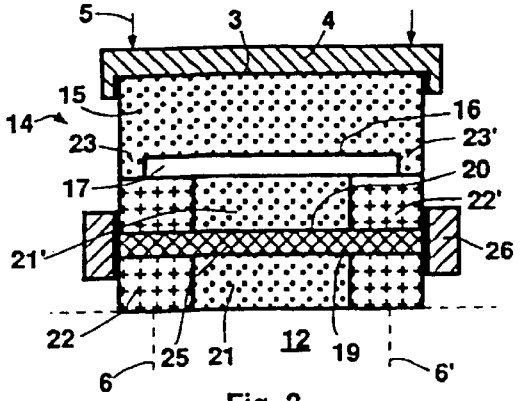
Fig. 3
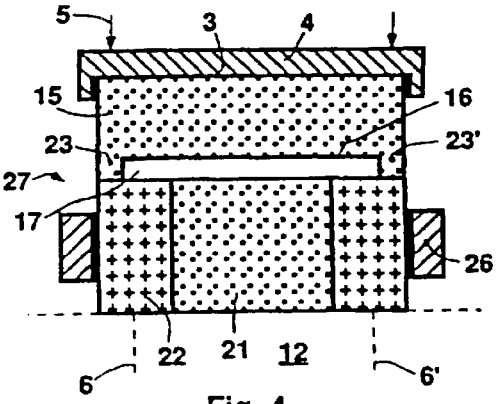
Fig. 4
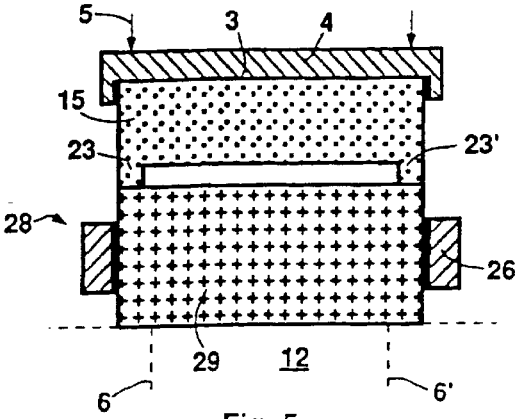
Fig. 5

SIDE WALL FOR INSTALLATION FOR CONTINUOUS CASTING OF METAL STRIPS

FIELD OF THE INVENTION

The invention relates to the continuous casting of metals. It relates more particularly to thin metal strip continuous casters of the type called "twin-roll casters".

PRIOR ART

The casting of thin metal strip a few mm in thickness directly from liquid metal (steel, stainless steel and other ferrous alloys, and copper, for example) may take place in a caster called a "twin-roll caster", supplied with liquid metal from a tundish by means of a pouring nozzle. The caster includes a mold whose casting space is bounded on its long sides by a pair of internally cooled rolls, having parallel horizontal axes and rotating about these axes in opposite directions, and on its short sides by closure plates made of refractory material, called "side walls", which are applied by thrust members against the flat ends of the rolls. Solidification of the liquid metal occurs against the cooled cylindrical surfaces of the rolls, by forming solidified shells which are made to join in the region of the nip (the region where the distance separating the surfaces of the rolls is a minimum) in order to form the strip, which is continuously extracted from the casting space. In some casters (which generally cast somewhat thicker products), the rolls may be replaced by moving cooled belts, which have been given a curved shape at the entrance of the casting space. These casters also have side walls similar to those of twin-roll casters and means for applying these side walls against the end faces of the belts. They are usually called "twin-belt casters".

Conventionally, each side wall is made as follows. It firstly comprises a support plate made of a material preferably having good insulating properties, such as silica. Usually, it is fastened on its rear face (the one facing outwards from the casting space) to a metal baseplate on which the thrust members act. However, if the support plate has sufficient mechanical strength and rigidity, provision may be made for the thrust members to exert their action directly on the support plate. Placed on the front face of this support plate is the active part of the side wall, that is to say the material or materials which are intended to come into contact with the rolls and with the liquid metal. Very often, the external regions of this active part, which have to come into contact with the rolls or be in the vicinity of the nip, are made of a first material exhibiting good properties of resistance to abrasion and to corrosion by the liquid metal, such as SiAlON® or silicon carbide, and the central region of this active part, which has to be in contact with the liquid metal, is made of a second material exhibiting good insulating properties, such as silica foam. Often the element or elements making up the external regions are referred to by the term "insert" and the element or elements forming the rest of the side wall by the term "core". Before starting the casting run, the side walls are preheated, for the purpose of preventing metal from solidifying on their active part when the casting space is being filled with liquid metal.

The side walls are of paramount importance in the success of twin-roll casting of metal strip, especially steel strip. Poor sealing of their contacts with the edges of the rolls may lead to exfiltration of liquid metal out of the casting space, which compromises the regularity of the operation of the plant, and hence the quality of the strip. In extreme cases, such exfiltration may result in the casting run being stopped. Likewise, rupture during casting of one of its elements, or deconsolidation of the many elements making up the active face, result in the casting run being immediately stopped. Very particular attention must therefore be paid to the choice of the materials for the side walls, some of which (in particular, the materials used for the insert) are very expensive. Likewise, the assembly of the side wall, and in particular the production of its active part, is a complex operation which has to be carried out by highly qualified and careful operators, and this assembly (and, after assembly the drying of the refractories and bonding materials used) requires a great deal of time. The side walls can only be used for a single casting run, after which they are dismantled, and at least their active part is discarded. For these reasons, the side walls constitute one of the main elements in the operating cost of a thin strip twin-roll caster (or, in general, a plant for casting between two moving cooled walls), and any technical advance which would make it possible to reduce the expenditure of time and of material which are associated with them, without impairing their performance or their reliability, is eminently desirable.

SUMMARY OF THE INVENTION

The object of the invention is to propose a design of the side walls of a caster for casting thin metal strip between two moving cooled walls whose manufacturing and operating cost is substantially reduced compared with side walls of conventional design.

For this purpose, the subject of the invention is a side wall for closing off the casting space of a caster for continuously casting thin metal strip between two moving cooled walls, especially a "twin-roll caster" or a "twin-belt caster", of the type comprising a support plate, on the rear face of which plate thrust members exert their action, for the purpose of applying said side wall against the end faces of said cooled walls, optionally via a metal baseplate fastened to the rear face of the support plate, and an active face placed against the front face of the support plate, the lateral portions of which are intended to be worn away on contact with said end faces of said cooled walls to a maximum depth "e" and over a width "1", the support plate and the active part being brought into contact with each other in a manner allowing them to be separated non-destructively, characterized in that the front face of the support plate has, in its central part, a recess, the depth of which is greater than "e", and in that the external edges of said front face have a general shape which matches that of the external edges of the active part and have a width of less than "1".

As will have been understood, the invention consists in designing the side wall so as to allow its active part to be used no longer for only one casting run, but for two, by simply inverting this active part between the two casting runs. For this purpose, the front face of the support plate must especially be given a special shape. Thus, a considerable amount of time is saved in preparing the side wall before the second casting run of the series.

BRIEF DESCRIPTION OF THE DRAWINGS

The invention will be more clearly understood on reading the description which follows, given with reference to the following appended figures:

FIG. 2, which shows, seen from above and in section on Ib—Ib, a first example of a side wall for casting thin strip according to the invention in its initial state before its first use (FIG. 2*a*) and before its second use (FIG. 2*b*);

FIG. 3, which shows, seen from above and in section on Ib—Ib, a second example of a side wall for casting thin strip according to the invention in its initial state, before its first use;

FIG. 4, which shows, seen from above and in section on Ib—Ib, a third example of a side wall for casting thin strip according to the invention in its initial state, before its first use;

FIG. 5, which shows, seen from above and in section on Ib—Ib, a fourth example of a side wall for casting thin strip according to the invention in its initial state, before its first use.

For the sake of clarity in the explanation of the basic principles of the invention, the various elements of the side walls have not been illustrated to scale in the figures. Usually, the casting rolls have a diameter of about 500 to 1500 mm and the nip has a width of a few mm, corresponding to the thickness of the strip that it is desired to cast.

DESCRIPTION OF THE PREFERRED EMBODIMENTS

Figure 1A:
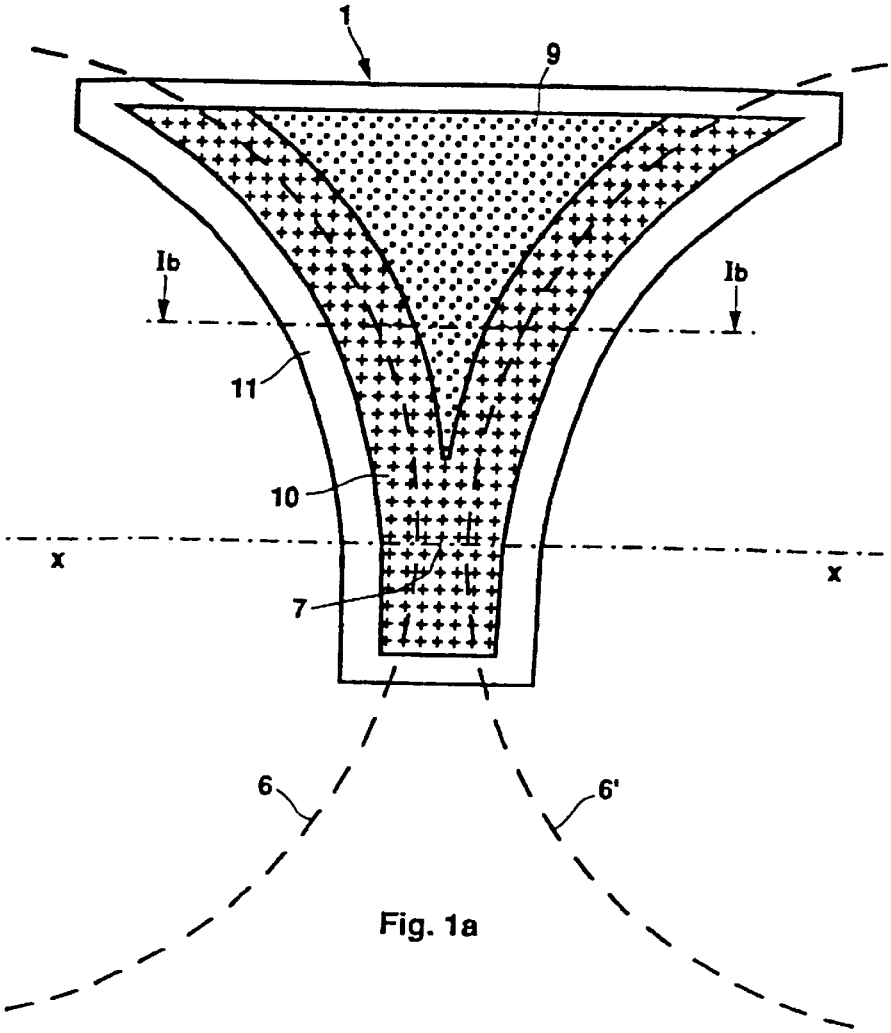
FIG. 1, which shows, seen from the front (FIG. 1*a*) and seen from above and in section on Ib—Ib, a side wall for casting thin strip according to the prior art in its initial state (FIG. 1*b*) and seen from above in section on Ib—Ib after its use (FIG. 1*c*)
Figure 1B:
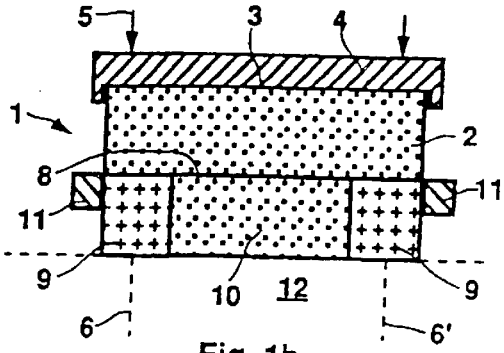

The example of a side wall 1 according to the prior art, illustrated schematically in FIG. 1, comprises the following elements:

- a support plate 2 made of refractory material having high insulating properties, fastened on its rear face 3 to a cooled metal baseplate 4 on which the thrust members (not illustrated) exert their action in the direction indicated by the arrows 5, so as to apply the side wall 1 against the end faces of the casting rolls; the contours 6, 6' of said rolls are drawn in dashed lines and the level of the nip 7 is indicated by a dot-dash line x—x;
- an active part placed on the plane front face 8 of the support plate 2, this active part being composed of two elements, namely a core 9 made of a refractory material exhibiting good insulating properties (such as silica foam) and an insert 10 made of a refractory material exhibiting good properties of resistance to frictional wear and to corrosion by the liquid metal (such as SiAlON® or silicon carbide); in the example illustrated, the insert 10 is formed by a single piece, but it may also be formed by the juxtaposition of several pieces; the core 9 and the insert 10 are fastened together, for example by bonding, and the entire active part which they form is surrounded by a band 11, preferably made of metal, which increases its cohesion.

The support plate 2 and the active part—core 9/insert 10—are held against each other, preferably by means allowing them to be separated after the casting run without destroying them or, at least, without damaging the support plate 2, so that the latter can be reused after said casting run. A system of bolts, or a cradle fastened to the support plate 2 or incorporated into it, into which cradle the active part is inserted, are examples of such means.

Figure 1C:
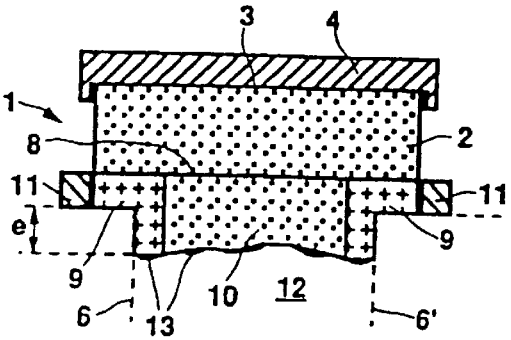

After having been used for just one casting run, the side wall 1 is in the state illustrated in FIG. 1*c*. Those portions of the insert 10 which rubbed against the rolls have been eroded to a depth "e" which may be of the order of several mm, or even several cm (typically, about 10 mm), depending on the duration of the casting run, the nature of the material of the insert 10 and the severity of the rubbing to which it has been subjected. The core 9 has been hollowed out due to corrosion by the liquid metal and also due to rubbing with the liquid metal moving inside the casting space 12. Moreover, the active part is often covered, at least in places, with a layer of solidified metal 13 which is deposited thereon at the end of casting. For these reasons, the active part of the side wall 1 can no longer be reused in a subsequent casting run, unless the entire active part is machined in order to restore its initial surface finish, a process which would be lengthy and expensive.

The first example of a side wall 14 according to the invention, illustrated in FIG. 2, has, when it is seen from the front, the same appearance as the side wall 1 according to the prior art illustrated in front view in FIG. 1*a*. This will also be the case with the other examples of side walls according to the invention which will be described below (except in the case of the fourth example shown in FIG. 5). A specific front view for the examples of side walls according to the invention will therefore not be shown. In FIG. 2, the elements common with the side wall 1 according to the prior art are denoted by the same reference numbers. This figure again shows, conventionally, a support plate 15 made of insulating refractory material, the rear face 3 of which is fastened to a metal baseplate 4 on which the thrust members act. On the other hand, the front face 16 of the support plate 15 is not plane: in its central part, over its entire height, it has a recess 17 whose shape and function will be explained below.

The active part of this side wall 14 also has a special configuration. It comprises a central plate 18 made of an insulating refractory having a low coefficient of expansion (for example, a silica-based refractory), having recesses 19, 20 on its two faces. Housed in each of these recesses 19, 20 is an assembly formed by a core 21, 21' and an insert 22, 22' whose constructions and dimensions (with the possible exception of the thickness) are identical to those of the core 10 and of the insert 9 of the side wall 1 according to the prior art described above. The two core-insert assemblies 21–22, 21'–22' are fastened to the central plate 18 by means of an adhesive allowing the adhesively bonded pieces to move relative to each other sufficiently to absorb the differential expansions due to the different types of materials involved. An example of such an adhesive is the product sold under the name "REFRACOL No. 4", which is a refractory grouting cement based on corundum, which includes a binder based on sodium silicate. This binder makes the adhesive glassy at high temperature, so as to allow relative movements of the bonded pieces working in shear.

The support plate 15 and the active part of the side wall 14 must, this time, necessarily be held against each other by means allowing them to be separated non-destructively, such as those already mentioned in the example of the side wall 1 of the prior art (a system of bolts, or a cradle).

After the side wall 14 according to the invention has been prepared and assembled, it is mounted on the caster, in the position illustrated in FIG. 2*a*, and used in the usual manner for a first casting run. At the end of this first casting run, the front face of the active part is again in the state described previously (and illustrated in FIG. 1*c*) of the front face of the active part of the side wall 1 of the prior art. The rolls have worn away the external edges of the insert 22 to a depth "e" and over a width "1", the core 21 has been hollowed out by chemical and mechanical erosion due to the liquid metal, and solidified metal 13 covers, at least in places, the front face of the active part. Once the first casting run has been completed, the active part of the side wall 14 is separated from the support plate 15 and turned upside down and repositioned on the support plate 15. In this way, the core 21 and the insert 22 which formed the front face of the active part during the first casting run may form its rear face during a second casting run. Conversely, the core 21' and the insert 22' which formed the rear face of the active part during the first casting run form its front face during this second casting run. This simple operation of dismantling, inverting and reassembling, which may be carried out very quickly, is therefore sufficient for re-establishing a side wall ready to use, whereas the preparation of a new side wall 1 of the type according to the prior art would have been much longer. It should be noted, in particular, that an operation of drying the refractories and the bonding materials is not needed for the preparation of the second casting run, since all the elements of the side wall 14 have already undergone this drying prior to the first casting run.

In order for the operation of reassembling the side wall 14 to be possible, the recess 17 in the support plate 15 must satisfy the following conditions. Its depth must be sufficient for those parts of the insert 22 and of the core 21, which are in relief with a thickness equal to "e" (or possibly greater than "e" in the regions where solidified metal 13 is present) compared with the worn external edges of the insert 22, to be able to be housed therein after inverting the active face. In other words, the depth of the recess 17 must be greater than the sum of "e" and the maximum thickness of the layers of solidified metal 13. The maximum values that these parameters might take during the first casting run must therefore be estimated, at least roughly, and the support plate 15 manufactured accordingly. Optionally, this calculation may take into account only "e" and it may be decided that if there is solidified metal 13 on the active part this will be removed by mechanical means. However, this risks increasing the time taken to prepare the side wall before the second casting run. With regard to the external edges 23, 23' of the support plate 15, these must have a general shape which matches that of the external edges of the insert 22 and a width of less than the width "1" of the worn parts of the insert 22 so as to be able to insert it therein. It is generally not necessary to machine said worn parts of the insert 22 before reassembling the side wall, the action of the rolls during the first casting run being sufficient for this purpose. In the side wall 1 of the prior art, it may be noted that it is the entire front face 8 of the support plate 2 which transfers the forces exerted by the thrust members to the active part, whereas in the side wall 14 according to the invention these forces are transferred only by the external edges 23, 23' of the support plate 15. However, this situation is not a problem since said external edges 23, 23' lie exactly opposite those regions of the active part which must rub against the rolls, therefore at the point where good transfer of the forces from the thrust members is particularly necessary in order to guarantee that the casting space 12 is sealed. From this standpoint, the novel configuration 15 of the support plate is therefore even more effective than the prior configuration 2.

The second example of a side wall according to the invention, 24, illustrated in FIG. 3 in its initial state before the start of the first casting run, is distinguished from the previous example only by the configuration of the central plate 25 of its active part. In this second example, said central plate 25 is a simple plane plate whose contour matches that of the insert 22-core 21 assembly. Cohesion of the entire active part of the side wall 24 is provided by a band 26, preferably made of metal, similar to the band 11 for the side wall 1 of the prior art described previously, whilst the configuration of the side wall 14 of the previous example entailed integrating such a band into the central plate 18 itself. The presence of a band 26 independent of the central plate 25 is advantageous in that it facilitates cohesion of the central plate 25 even in the case of the latter fracturing.

The third example of a side wall according to the invention, 27, illustrated in FIG. 4 in its initial state before the start of the first casting run, is distinguished from the previous example in that the central plate 25 of the active part is omitted. It is the same core 21 and the same insert 22 that are used during the two casting runs, successively on their two faces. Here again, a band 26, preferably made of metal, ensures their cohesion.

The fourth example of a side wall according to the invention, 28, illustrated in FIG. 5 in its initial state before the start of the first casting run, is distinguished from the previous example in that the active part is formed only from a single element 29 whose functions combine those of the core 21 and of the insert 22 of the previous example. Since this element 29 must ensure that the casting space 12 is sealed, by its contact with the rolls, it must be made of a material which has to have good properties of resistance to wear and to corrosion by the metal. However, it must also have, optimally, insulating properties that are as good as possible and good resistance to heat shock and to cracking in order to exhibit acceptable behavior in its central part. Materials such as boron nitride and SiAlON® can be used for this purpose. The presence of a band 26 surrounding the active part of the side wall 28 is not absolutely essential since this active part is of a one-piece construction and, in principle, its cohesion is ensured. However, such a band 26 is nevertheless recommended since it allows the consequences of the element 29 possibly cracking during its use to be minimized.

In the same way, it is possible in all the previous examples of side walls according to the invention to replace the insert 22, 22'-core 21, 21' assemblies placed on each side of the central plate 18, by single elements similar to the element 29. This therefore results in a reduction in the time required to prepare the side wall but, on the other hand, the cost of the materials increases since the materials capable of correctly fulfilling both the insert function and the core function are more expensive than the materials more conventionally used for one or other of these functions.

The invention may apply not only to twin-roll casters but also to any type of thin metal strip caster using side walls according to the abovementioned prior art which are applied against the end faces of moving cooled walls, such as twin-belt casters.

What is claimed is:

1. A side wall for closing off a casting space of a caster for continuously casting a thin metal strip between two moving cooled walls, especially a "twin-roll caster" or a "twin-belt caster", of a type comprising a support plate, on a rear face of which plate thrust members exert their action, for the purpose of applying said side wall against end faces of said cooled walls, optionally via a metal baseplate fastened to the rear face of the support plate, and an active face placed against a front face of the support plate, lateral portions of which are intended to be worn away on contact with said end faces of said cooled walls to a maximum depth "e" and over a width "1", the support plate and the active part being brought into contact with each other in a manner allowing them to be separated non-destructively, wherein the front face of the support plate has, in a central part, a recess, the depth of which is greater than "e", and in that external edges of said front face have a general shape which matches that of external edges of the active part and have a width of less than "1".

2. The side wall as claimed in claim 1, further comprising a band surrounding said active part.

3. The side wall as claimed in claim 1, wherein said active part comprises at least one core and one insert.

4. The side wall as claimed in claim 2, wherein said active part comprises at least one core and one insert.

5. The side wall as claimed in claim 3, wherein the active part comprises a central plate having, on each of its two faces, a core and an insert.

6. The side wall as claimed in claim 4, wherein the active part comprises a central plate having, on each of its two faces, a core and an insert.

7. The side wall as claimed in claim 5, wherein said band is structurally incorporated into said central plate.

8. The side wall as claimed in claim 6, wherein said band is structurally incorporated into said central plate.

* * * * *

UNITED STATES PATENT AND TRADEMARK OFFICE

CERTIFICATE OF CORRECTION

PATENT NO. : 6,488,075 B1
DATED : December 3, 2002
INVENTOR(S) : Breviere et al.

It is certified that error appears in the above-identified patent and that said Letters Patent is hereby corrected as shown below:

Title page,
Item [75], Inventor, should read:

-- [75] Inventors: Yann Breviere, Ecquedecques (FR); Jean-Michel Damasse, Duesseldorf (DE); Dominique Themines, Krefeld (DE) --

Signed and Sealed this

Twentieth Day of May, 2003

JAMES E. ROGAN
*Director of the United States Patent and Trademark Office*